US009121183B1

(12) United States Patent
Marmon

(10) Patent No.: US 9,121,183 B1
(45) Date of Patent: Sep. 1, 2015

(54) MOISTURE RESISTANT WOOD FLOORING PANEL

(71) Applicant: Joseph Marmon, Oswego, NY (US)

(72) Inventor: Joseph Marmon, Oswego, NY (US)

( * ) Notice: Subject to any disclaimer, the term of this patent is extended or adjusted under 35 U.S.C. 154(b) by 0 days.

(21) Appl. No.: 14/549,162

(22) Filed: Nov. 20, 2014

(51) Int. Cl.
*E04B 2/00* (2006.01)
*E04F 15/02* (2006.01)

(52) U.S. Cl.
CPC ..... *E04F 15/02188* (2013.01); *E04F 15/0215* (2013.01); *E04F 15/02038* (2013.01); *E04F 15/02172* (2013.01)

(58) Field of Classification Search
CPC . E04F 15/02038; E04F 15/0215; E04F 15/10; E04F 15/18; E04F 15/02133; E04F 15/107
See application file for complete search history.

(56) References Cited

U.S. PATENT DOCUMENTS

| | | | | | |
|---|---|---|---|---|---|
| 548,657 | A | | 10/1895 | Ransome | |
| 801,108 | A | | 10/1905 | Romanoff | |
| 1,532,504 | A | | 4/1925 | Lichtenfeld | |
| 2,006,635 | A | | 7/1935 | Farr | |
| 3,436,888 | A | * | 4/1969 | Ottosson | 52/480 |
| 3,717,247 | A | * | 2/1973 | Moore | 206/321 |
| 3,740,911 | A | | 6/1973 | O'Leary | |
| 3,905,172 | A | * | 9/1975 | Blackburn | 52/745.05 |
| 4,047,344 | A | | 9/1977 | Postman et al. | |
| 4,090,338 | A | * | 5/1978 | Bourgade | 52/392 |
| 4,471,012 | A | | 9/1984 | Maxwell | |
| 4,654,388 | A | * | 3/1987 | Lofgren | 524/272 |
| 4,796,402 | A | * | 1/1989 | Pajala | 52/390 |
| 4,953,335 | A | | 9/1990 | Kawaguchi et al. | |
| 5,058,349 | A | * | 10/1991 | Conrad | 52/392 |
| 5,103,414 | A | * | 4/1992 | Papadopoulos | 700/279 |
| 5,103,614 | A | | 4/1992 | Kawaguchi et al. | |
| 5,258,425 | A | * | 11/1993 | Kirby | 523/337 |
| 5,283,102 | A | | 2/1994 | Sweet et al. | |
| 5,455,293 | A | * | 10/1995 | Wood et al. | 524/271 |
| 5,827,393 | A | * | 10/1998 | Kinzelmann et al. | 156/308.2 |
| 5,830,549 | A | | 11/1998 | Sweet et al. | |
| 5,894,700 | A | | 4/1999 | Sweet | |
| 6,021,615 | A | * | 2/2000 | Brown | 52/392 |
| 6,119,423 | A | * | 9/2000 | Costantino | 52/390 |
| 6,180,244 | B1 | * | 1/2001 | Rayner et al. | 428/424.8 |
| 6,182,414 | B1 | * | 2/2001 | Huang | 52/592.1 |
| 7,603,824 | B1 | * | 10/2009 | Hartanto | 52/384 |
| D687,572 | S | * | 8/2013 | Thibodeau et al. | D25/138 |
| 8,728,260 | B2 | * | 5/2014 | Dodge et al. | 156/60 |
| 2004/0211130 | A1 | * | 10/2004 | Horstman et al. | 52/177 |
| 2012/0276348 | A1 | * | 11/2012 | Clausi et al. | 428/196 |
| 2012/0291387 | A1 | * | 11/2012 | Keane | 52/403.1 |

* cited by examiner

*Primary Examiner* — Mark Wendall
*Assistant Examiner* — Keith Minter
(74) *Attorney, Agent, or Firm* — Harris Beach PLLC

(57) ABSTRACT

A wood flooring panel includes a plurality of parallel longitudinal wood slats situated side by side. A latex vinyl impregnated flexible backing paper is affixed by a polyurethane resin adhesive to a back side of the slats to accurately hold the slats as a panel. The latex vinyl impregnated flexible backing paper is of a material that is inextensible in the longitudinal and lateral directions, but flexible to permit bending at joints defined between the wood slats. The latex vinyl impregnated flexible backing paper acts a primary protective moisture barrier to a subfloor, and a polyurethane resin adhesive acts as a secondary protective moisture barrier to the subfloor. A method of installing a hardwood floor is also described.

12 Claims, 3 Drawing Sheets

MOISTURE RESISTANT WOOD FLOORING PANEL

FIELD OF THE APPLICATION

The application relates to a moisture resistant wood floor paneling and particularly to an improved wood floor paneling having multiple moisture barriers.

BACKGROUND

Wood flooring has traditionally been laid for hundreds of years as long slats affixed by flooring nails. In recent years, there has been a trend towards prefinished flooring products. Some such wood flooring products include a number of pre-assembled slats.

SUMMARY

According to one aspect, a wood flooring panel includes a plurality of parallel longitudinal wood slats situated side by side. Each slat of the plurality of parallel longitudinal wood slats has back and face surfaces, left and right sides, a front end and a rear end, and the slats being of a same length but staggered in their longitudinal positions. A latex vinyl impregnated flexible backing paper is affixed by a polyurethane resin adhesive to a back side of the slats to accurately hold the slats as a panel. The latex vinyl impregnated flexible backing paper is of a material that is inextensible in the longitudinal and lateral directions, but flexible to permit bending at joints defined between the wood slats. The latex vinyl impregnated flexible backing paper acts a primary protective moisture barrier to a subfloor, and the polyurethane resin adhesive acts as a secondary protective moisture barrier to the subfloor.

In one embodiment, the slats include tongues formed at the front ends and mating grooves formed at the rear ends thereof.

In another embodiment, the panel has a rightmost slat and a leftmost slat, with one of the rightmost and leftmost slats having a tongue formed on an outer edge thereof, and the other of the rightmost and leftmost slats having a mating groove formed in an outer edge thereof.

In yet another embodiment, a longitudinal edge of each of the slats, with an exception of the outer edges of the rightmost and leftmost slats, are flush and without tongue or groove.

In yet another embodiment, the slats are made of three or more plies including a soybean resin.

In yet another embodiment, the slats are substantially free of formaldehyde.

In yet another embodiment, the wood flooring panel has formaldehyde emissions of less than or equal to 0.05 parts per million (ppm).

In yet another embodiment, the slats are made of an all wood material formed of recycled and milled forest product material.

According to another aspect, a method of installing a hardwood floor formed of a series of wood flooring panels, each panel including a plurality of parallel longitudinal wood slats situated side by side each the slat having back and face surfaces, left and right sides, a front end and a rear end, and the slats being of the same length but staggered in their longitudinal positions; a vinyl impregnated flexible paper backing adhesively secured to a back side of the slats to hold the slats as a panel, with the backing being of a material that is inextensible in the longitudinal and lateral directions, but flexible to permit bending at joints defined between the wood slats includes: preparing a flat horizontal floor space; applying a flooring adhesive onto the floor space; laying one the panel onto the flooring adhesive on the floor space; laying a successive such panel in end to end relation with a first-mentioned panel such that rear ends of the slats of a successive panel are place into grooves of the first-mentioned panel, with corresponding rear ends fitting against the respective front ends of the slats of the first-mentioned panel; and laying an adjacent panel onto the floor space with a leftmost slat of one of the first-mentioned panel and the adjacent panel in side by side relation with a rightmost slat of the other of the first-mentioned panel and adjacent panels.

In one embodiment, the step of laying the adjacent panel includes staggering the position of the adjacent panel with respect to the first-mentioned panel.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

Figure 1:
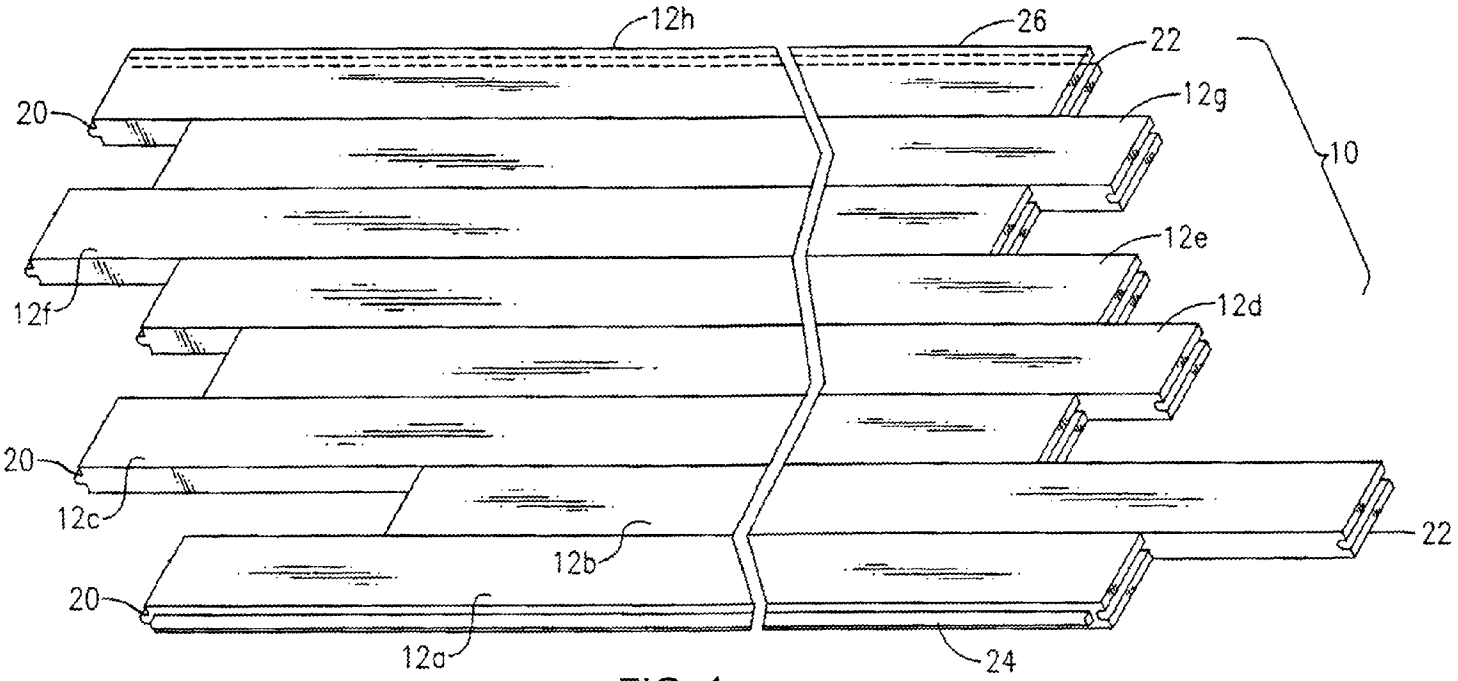
FIG. 1 shows an illustration of a perspective view of an exemplary wood flooring panel.

Wood floor coverings and hardwood floors in particular have been expensive to construct and to install, and it has long been sought to find a suitable technique for the economical fabrication of attractive, durable floors. In particular, the big box retail chains have long sought a flooring technique that is user friendly to weekend do it yourselfers (DIY), as well as suited for use by professional installers. Applications for such new flooring techniques include retail stores, restaurants, office spaces, or the like, where a durable hardwood flooring surface is desired. It has also been desired to achieve the speedy and cost effective installation of a random-length appearance hardwood flooring both above and below grades, such as by use of the wood flooring manufacturers association (NOFMA) approved conventional flooring adhesives.

A number of flooring techniques of the prior art lack one or more desirable flooring characteristic. To our knowledge, none of these prior art approaches have achieved considerable success in the marketplace. For example, U.S. Pat. No. 5,103,414 to Kawayashi et al. and U.S. Pat. No. 5,058,349 to Conrad, described flooring systems in which hardwood strips were combined into tiles or panels. Another prefabricated flooring system was described in U.S. Pat. No. 3,717,247 to Moore. Parquet flooring tiles were discussed in U.S. Pat. No. 4,090,338 to Bourgade and U.S. Pat. No. 3,436,888 to Ottosson. A hardwood flooring system that can create a random look was described in U.S. Pat. No. 3,905,172 to Blackburn. None of the previously proposed hardwood floor systems is able to create a floor with the look of random slat lengths, with the convenience of an adhesive installation and with the durability of a more traditional tongue and groove construction.

Another wood paneling system and method was described in U.S. Pat. No. 6,021,615, to Brown, WOOD FLOORING PANEL. The '615 patent is incorporated herein by reference in its entirety for all purposes. While the wood flooring panel of the '615 patent was a significant advance over the art of wood paneling as of the end of the last century, the panels of the '615 turned out to have several problems. For example, the tab or clip at the end of each board was intended to help an installer more quickly align mating wood flooring panels as they were laid on an adhesive. The clips were also intended to help keep adhesive out of the joints between the ends of each slat of the wood flooring panels. However, it turned out that the tabs or clips tended to dig into an adhesive layer underlayment and undesirably scooped flooring adhesive onto the tab or clip which made some installations more difficult. Also, the prior art tambour backing was less robust than desired and provided insufficient moisture resistance. Another problem was that the tambour paper came coated with a fine layer of poly vinyl acetate glue. The paper was typically pressed onto the planks using a heated platen. The glue and the adhesion process did not completely or consistently secure the flexible backer board to the planks. Also, the poly vinyl acetate glue did not provide a moisture protection barrier.

Thus, there is a need for a more robust wood flooring panel that does not scoop excessive adhesive into the joints between panels during assembly. Yet another problem with the floor paneling of the prior art is that the tambour backing proved insufficient in some installations to protect the wood panel from moisture ingress from the subsurface (e.g. concrete) below the wood flooring panel. Also needed, is a wood flooring panel that can better resist moisture ingress from below.

Figure 2:
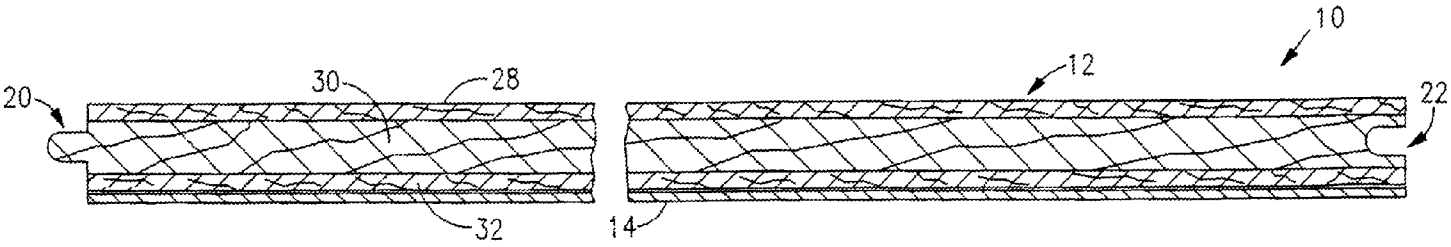
FIG. 2 shows an illustration of a cross sectional view of the wood flooring panel of FIG. 1.
Figure 3:
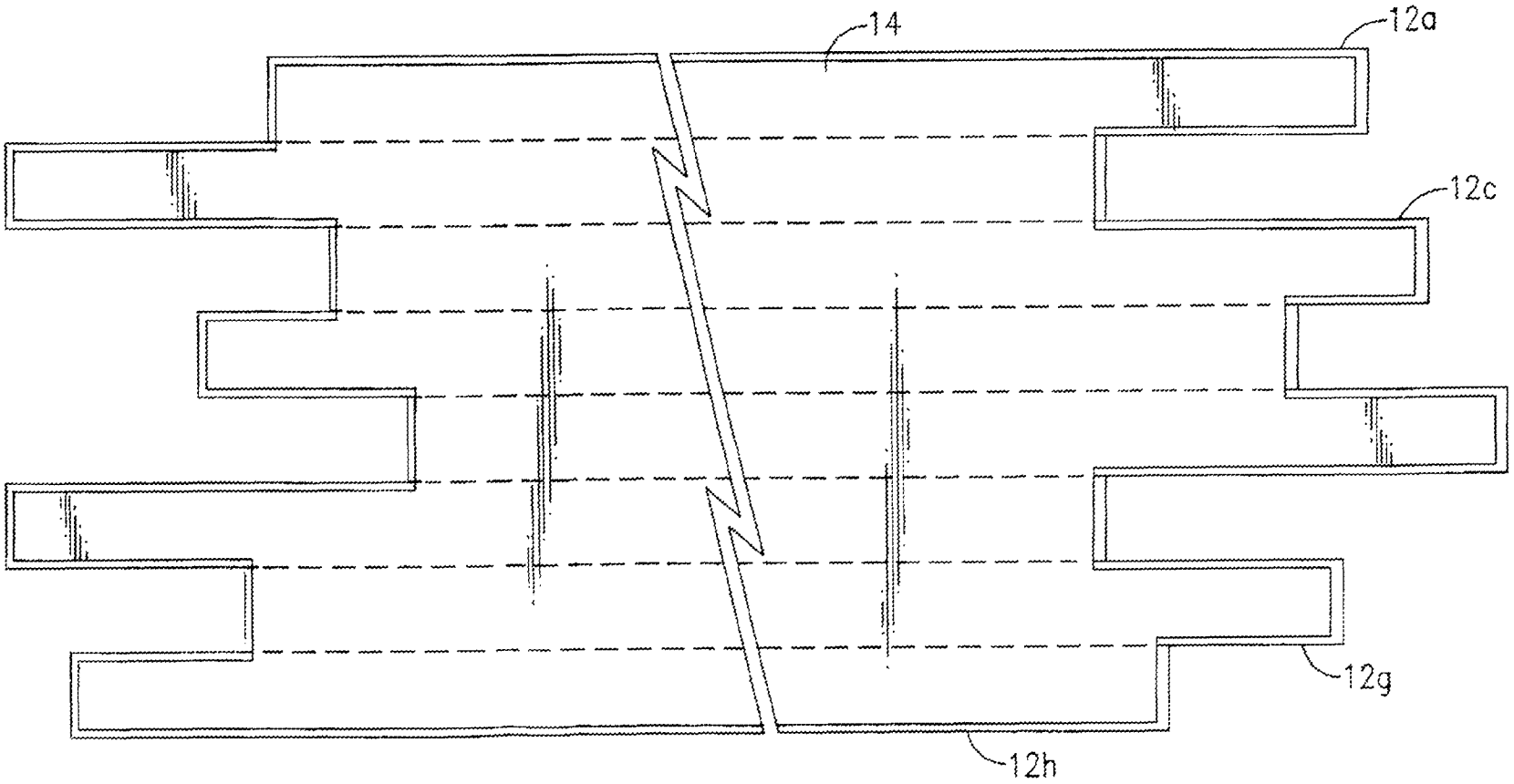
FIG. 3 shows an illustration of a bottom plan view of the wood flooring panel of FIG. 1.

With reference to the Drawing, FIGS. 1 to 3 illustrate a hardwood flooring panel 10. The exemplary panel 10 includes eight wood slats or fingers 12*a* to 12*h*, with slat 12*a* being the leftmost slat and slat 12*h* being the rightmost slat. Here, each exemplary slat 12*a* to 12*h* is 58 5/16" inches in length, three inches in width, and three-eighths inch thick. FIGS. 1 to 3 represent a 3" configuration. Similar configurations can be made, for example, in four inches and five inches widths with six slates on the four inch configuration and four slates on the five inch configuration. The slats are secured onto a flexible backing paper, such as, for example, a 10 mil latex vinyl impregnated flexible backing paper 14. A latex vinyl impregnated flexible backing paper can provide a layer of moisture resistance, as a moisture barrier to help prevent moisture ingress into the wood flooring panel.

The ends of the slats are positioned such that when the two panels are joined end to end, the two panels create a staggered random appearance between the panels.

In the exemplary embodiment of FIG. 1, slats 12 have a tongue and groove construction at the ends of each slat, with a tongue or bead 20 formed at a first end and a mating groove 22 formed at the opposite end. The tongue and the groove of successive panels interlock in a fashion well known to those skilled in the art.

As shown in FIG. 1, a tongue or bead 24 is formed along the outer edge of the leftmost slat 12*a*, and a groove 26 (illustrated in ghost) is formed in the outer edge of the rightmost slat 12*h* of each panel.

The slats or fingers can be made of solid hardwood or engineered wood substrates. Alternatively, a composite material can be used, such as, for example, a composite made of composite wood, paper, or other forest product material. The terms "wood" and "hardwood" are defined as including any material suitable for use as a flooring slat or strip, and which can be cut and milled using woodworking tools and equipment known to those skilled in the art.

The slats of a wood flooring panel can be glued together side by side by use of a polyurethane hot melt glue.

In the exemplary embodiment of FIG. 2, slat 12 is made of multiple plies of hardwood. Here three plies are shown, but any number of plies can be used. There is a top or face ply 28, a center ply or core 30, and a bottom or back ply 32. The core can also be of the same species.

A glue, such as, for example, a polyurethane resin (PUR) hot melt glue can be used to secure the vinyl impregnated flexible backing 14 onto the bottom face or ply 32 of slat 12. The PUR glue and latex vinyl impregnated flexible backing paper also acts as primary and secondary moisture protective barriers to the flooring slats. The PUR glue provides a second layer of moisture resistance beyond the first layer of the vinyl impregnated flexible backing paper, to help prevent moisture ingress into the wood flooring panel. This dual layer moisture resistant wood panel feature prevents moisture wicking through the bottom of the subfloor creating swelling, delamination of the substrates and lifting of the face of the slats.

Example

In some embodiments, the flexible backing comprises Neenah Papers products 7182P0 or a Neenah Papers products 5998P0, available from Neenah Paper, Inc. of Alpharetta, Ga., both latex saturated with a heat and pressure activated coating on 1 side. Both have no-added formaldehyde and are Forest Stewardship Council (FSC) certified grades. This improvement coupled with the application use of polyurethane hot melt glue ensures fiber pull from the backer paper to the backs of the planks forming a consistent and complete seal.

The wood flooring panels described hereinabove in the form of hardwood engineered tiles or panels can be adhesively applied onto a subflooring of concrete, wood or other materials. Any suitable adhesive or glue can be used to bond the panelized flooring system described herein to any suitable subsurface.

Example

To bond the panelized flooring system to any subsurface—The Axios™ Tri-Linking™ Technology as offered by Bostik™ Greenforest™ or Utra-Set Singlestep2™ adhesives available from Bostik Americas Technology Center of Wauwatosa, Wis. provide a consistently strong bond offering a third protection barrier from moisture infiltration, as well as, sound abatement quality equal to ¼" thick underlayment.

As shown in FIG. 1, the edges of all the slats 12, other than the outer edges of the slats 12*a* and 12*h*, can be square or flush, i.e., provided without tongue or groove on the sides. This is seen, e.g., on the exposed edges of slats 12*b* and 12*c*.

Panels 10 can be precisely milled in the factory with very little variation from nominal measurements to ensure an exact fit regardless of the time of manufacturing of each panel. The latex vinyl impregnated flexible backing paper 14 can be cut to any desired shape, i.e., as shown in FIG. 3. The slats can be arranged side by side on a template (not shown), such as with the bottom faces up. The latex vinyl impregnated flexible backing paper can be sent through a gluing station where a metered gram weight of PUR is evenly applied and then laid in place as a glued assembly. The assembly can then be passed through a series of pinch rollers where the glue becomes activated and bonds the vinyl impregnated backing paper to the slats thus creating the panelized system.

Figure 4:
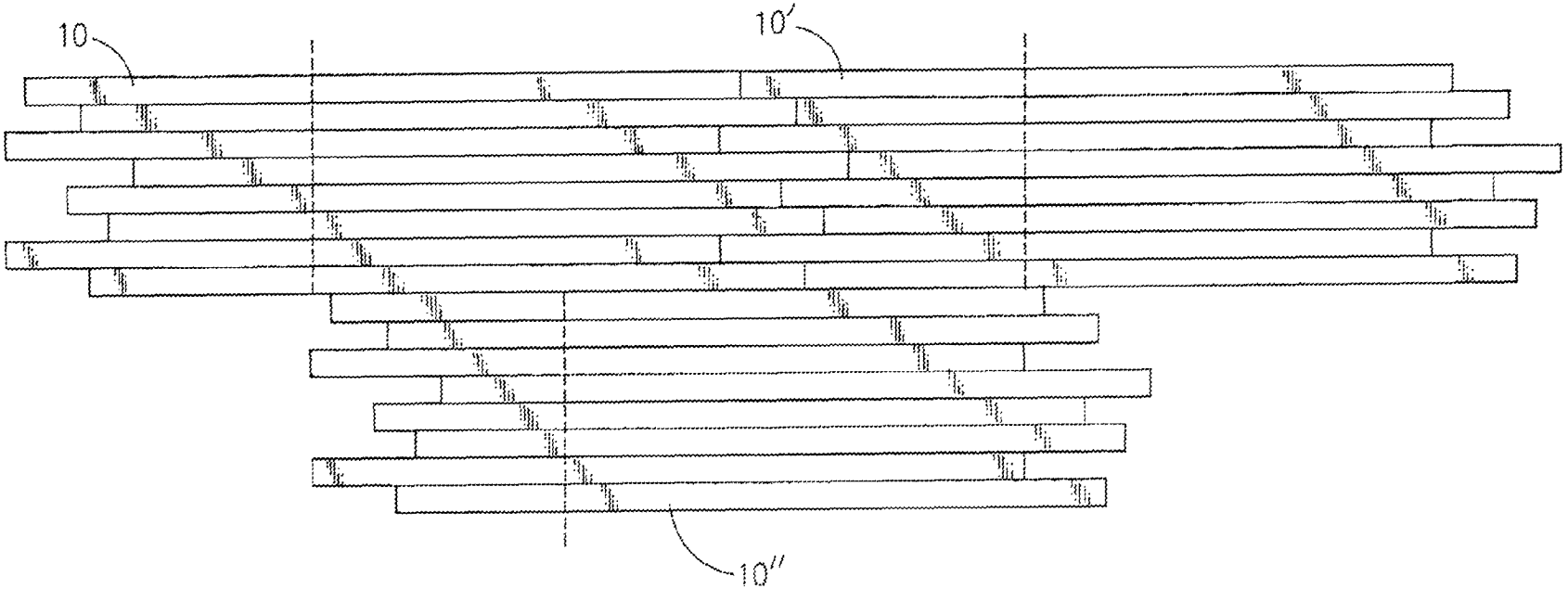
FIG. 4 shows a schematic view illustrating the installation of the wood flooring panels according to FIG. 1.

The flooring system as described hereinabove can be installed with little to no woodworking experience. First, the subfloor or base is prepared. In the case of a concrete floor space, this may include repairing cracks and applying mortar or other material to smooth out any uneven areas. A standard flooring adhesive is then applied onto the floor space. The wood flooring panels are laid onto the adhesive on the floor space. As shown in FIG. 4, after a first panel 10 has been installed, then a second panel 10' is joined to it, end-to-end. The grooves 22 of the second panel 10' fit onto the tongues 20 of the first panel. Additional panels are installed in this fashion across the floor space. Partial length panels are placed at the ends to meet against the walls or edges of the floor space.

An adjacent panel 10" can be installed side by side, but staggered, as shown, with respect to the panels 10 and 10'. This placement increases the randomness appearance in the ends of the slats, to enhance the random look of the flooring. The installation is continued in this fashion until the floor space is covered. A final row may require partial-width panels which can be cut or sawed using standard wood saws or woodworking tools known to those skilled in the art.

The California Air Resources Board (CARB) approved a new standard of formaldehyde emissions controls called the Airborne Toxics Control Measure (ATCM). The measure provides standard formaldehyde emissions ratings for all composite wood and manufactured wood products, including particleboard, hardwood, plywood, medium-density fiberboard, and also from finished products manufactured with composite wood parts. The two-phase plan (CARB I, CARB II) requires manufacturers to comply with strict standards for any product that includes a composite wood product for manufacturing, sale, use, or supply within the state of California. The CARB study suggests that substandard composite wood products currently generate up to 5% of household formaldehyde emissions. The measurement is specifically used in the panelized system to measure emissions of formaldehyde gas from the glues used to bond the layers of engineered wood in the flooring planks. Phase I of the United States CARB plan requires that adhesive formaldehyde emissions measure equal to or less than 0.08 ppm (parts per million), a figure that exceeds present OSHA standards. In Phase II, decreased formaldehyde emissions in adhesives to 0.05 ppm are called for, a higher standard than that of the European Union (EU).

The slats of the flooring panels can be made of three or more plies including a soybean resin. The resin can be used to fix any suitable wood material into the wood slats, such as, for example, wood materials formed of recycled and milled forest product material. Such slats, e.g., using soybean resin can be made substantially free of formaldehyde. By use of relatively non-toxic materials such as soybean resin and recycled and milled forest product material, flooring panels as described herein comply with and exceed United States governing allowances of formaldehyde contents, such as through the use of soybean resins. Such flooring panel also exceeds CARB II compliance criteria.

Example

Mills construction of the hardwood plywood using the materials and manufacturing techniques described herein can comply with the standards of Section 93120.2, title 17, California Code of Regulations, Final Regulations Order meeting the following results; CARB Phase I; 0.08 parts per million and CARB Phase II; 0.05 parts per million, as well as carry the Hardwood Plywood & Veneer Association Laboratory and Testing Service's HPVA TPC-8 label. Such testing can, for example, be based on the primary test method [ASTM E 1333-96(2002)] in parts per million (ppm) for both veneer core (HWPW-VC) and composite core (HWPW-CC).

While a wood veneer can be present top and bottom of each slat, a bottom veneer has been found to be unnecessary for reasons of uniform thermal expansion. Therefore, in most embodiments, the wood flooring panels can be made more efficiently and at lower cost with only a single top layer of veneer. The top decorative surface can be finished, for example, with 7 coats of varnish (example of a suitable type of varnish and source) which can be UV cured. The varnish can also include anti-microbial agent to minimize undesirable biological growth as can be promoted by excess moisture.

Flooring materials as described hereinabove can be box packaged for ease of handling and protection, and are installed, typically with a labor savings as compared with other flooring materials. On the other hand, because of the randomness or arbitrary staggering of the ends of the slats, the finished floors have a traditional hardwood floor appearance. Floors made from the improved wood flooring panels as described hereinabove are also durable and easily withstand the foot traffic typical of residential, light commercial and similar environments.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A wood flooring panel comprising:

a plurality of parallel longitudinal wood slats situated side by side, each slat of said plurality of parallel longitudinal wood slats having back and face surfaces, left and right sides, a front end and a rear end, and said slats being of a same length but staggered in their longitudinal positions;

a latex vinyl impregnated flexible backing paper affixed by a polyurethane resin hot melt adhesive to a back side of said slats to hold the slats as a panel, with said latex vinyl impregnated flexible backing paper being of a material that is inextensible in the longitudinal and lateral directions, but flexible to permit bending at joints defined between said wood slats; and wherein the latex vinyl impregnated flexible backing paper acts a primary protective moisture barrier to a subfloor, and the polyurethane resin hot melt adhesive acts as a secondary protective moisture barrier to the subfloor.

2. The wood flooring panel of claim 1, wherein said slats comprise tongues formed at said front ends and mating grooves formed at the rear ends thereof.

3. The wood flooring panel of claim 1, wherein said panel has a rightmost slat and a leftmost slat, with one of said rightmost and leftmost slats having a tongue formed on an outer edge thereof, and the other of the rightmost and leftmost slats having a mating groove formed in an outer edge thereof.

4. The wood flooring panel of claim 3, wherein a longitudinal edge of each of said slats, with an exception of said outer edges of said rightmost and leftmost slats, are flush and without tongue or groove.

5. The wood flooring panel of claim 3, wherein said slats are made of three or more plies comprising a soybean resin.

6. The wood flooring panel of claim 5, wherein said slats are substantially free of formaldehyde.

7. The wood flooring panel of claim 5, wherein said wood flooring panel has formaldehyde emissions of less than or equal to 0.05 parts per million (ppm).

8. The wood flooring panel of claim 5, wherein said slats are made of an all wood material formed of recycled and milled forest product material.

9. The wood flooring panel of claim 1, wherein said latex vinyl impregnated flexible backing paper further includes a heat and pressure activated coating which when coupled with the polyurethane resin hot melt adhesive provides a fiber pull of said latex vinyl impregnated flexible backing paper.

10. A method of installing a hardwood floor formed of a series of wood flooring panels, each panel comprising a plurality of parallel longitudinal wood slats situated side by side each said slat having back and face surfaces, left and right sides, a front end and a rear end, and said slats being of the same length but staggered in their longitudinal positions; a vinyl impregnated flexible paper backing adhesively secured to a back side of said slats by a polyurethane resin hot melt adhesive to hold the slats as a panel, with said backing being of a material that is inextensible in the longitudinal and lateral directions, but flexible to permit bending at joints defined between said wood slats; the method comprising:

preparing a flat horizontal floor space;

applying a flooring adhesive onto said floor space;

laying one said panel onto the flooring adhesive on said floor space;

laying a successive such panel in end to end relation with a first-mentioned panel such that rear ends of the slats of a successive panel are place into grooves of the first-mentioned panel, with corresponding rear ends fitting against the respective front ends of the slats of the first-mentioned panel; and laying an adjacent panel onto said floor space with a leftmost slat of one of the first-mentioned panel and said adjacent panel in side by side relation with a rightmost slat of the other of the first-mentioned panel and adjacent panels.

11. The method of installing a hardwood floor of claim 10, wherein the step of laying said adjacent panel includes staggering the position of the adjacent panel with respect to the first-mentioned panel.

12. A wood flooring panel comprising:

a plurality of parallel longitudinal wood slats situated side by side, each slat of said plurality of parallel longitudinal wood slats having back and face surfaces, left and right sides, a front end and a rear end, and said slats being of a same length but staggered in their longitudinal positions;

a latex vinyl impregnated flexible backing paper inextensible in the longitudinal and lateral directions, but flexible to permit bending at joints defined between said wood slats, said latex vinyl impregnated flexible backing paper having a heat and pressure activated coating;

wherein said heat and pressure activated coating in combination with the polyurethane resin hot melt adhesive provides a fiber pull of said latex vinyl impregnated flexible backing paper; and wherein the latex vinyl impregnated flexible backing paper acts a primary protective moisture barrier to a subfloor, and the polyurethane resin hot melt adhesive acts as a secondary protective moisture barrier to the subfloor.

* * * * *